US007984521B2

(12) United States Patent
Schintler et al.

(10) Patent No.: US 7,984,521 B2
(45) Date of Patent: Jul. 26, 2011

(54) DEVICE FOR ACTUATING THE DRAINAGE VALVE OF A SANITARY ARTICLE

(75) Inventors: Michael Schintler, Pfäffikon (CH); Martin Rüdisser, Jona (CH)

(73) Assignee: Geberit Technik AG, Jona (CH)

( * ) Notice: Subject to any disclaimer, the term of this patent is extended or adjusted under 35 U.S.C. 154(b) by 758 days.

(21) Appl. No.: 11/730,162

(22) Filed: Mar. 29, 2007

(65) Prior Publication Data

US 2007/0289059 A1 Dec. 20, 2007

(30) Foreign Application Priority Data

Jun. 20, 2006 (EP) ..... 06405263

(51) Int. Cl.
*E03C 1/23* (2006.01)

(52) U.S. Cl. ..... 4/689; 4/688; 4/685; 4/684

(58) Field of Classification Search ..... 4/688, 689, 4/293, 684, 685, 287
See application file for complete search history.

(56) References Cited

U.S. PATENT DOCUMENTS

| | | | | |
|---|---|---|---|---|
| 1,710,289 | A * | 4/1929 | Bresler | 4/690 |
| 1,974,419 | A * | 9/1934 | Cornell, Jr. | 4/688 |
| 4,411,028 | A * | 10/1983 | Hogner | 4/691 |
| 4,596,057 | A | 6/1986 | Ohta et al. | |
| 4,860,390 | A * | 8/1989 | Ohta | 4/287 |
| 5,305,474 | A * | 4/1994 | Nardi et al. | 4/324 |
| 5,787,521 | A * | 8/1998 | O'Connell et al. | 4/689 |
| 6,347,417 | B1 * | 2/2002 | Ohta | 4/689 |
| 6,637,051 | B1 * | 10/2003 | Swart | 4/688 |
| 2006/0179564 | A1 * | 8/2006 | Jacobs | 4/689 |
| 2009/0158522 | A1 * | 6/2009 | Wu | 4/689 |

FOREIGN PATENT DOCUMENTS

| | | | |
|---|---|---|---|
| AT | 317097 | | 8/1974 |
| DE | 44 45 649 | A1 | 6/1996 |
| EP | 0426224 | A1 * | 5/1991 |
| EP | 0542063 | A1 * | 10/1992 |
| EP | 1 118 724 | A1 | 7/2001 |
| FR | 2582032 | A1 * | 4/1985 |
| FR | 2 799 777 | A1 | 4/2001 |
| GB | 2010086 | A | 6/1979 |
| GB | 2184011 | A | 6/1987 |
| JP | 05346029 | A * | 12/1993 |
| JP | 05346030 | A * | 12/1993 |

* cited by examiner

*Primary Examiner* — Khoa D Huynh
(74) *Attorney, Agent, or Firm* — Sughrue Mion, PLLC

(57) ABSTRACT

The device has a housing (5) which can be fastened on the sanitary article (2) and in which is mounted a pushbutton (7) for actuating the drainage valve (A). A pulling element (16) connects the pushbutton (7) to a closure body (33) which is mounted in a displaceable manner in a housing (22) of the drainage valve (A). A changeover device (26) is mounted on the housing (22) of the drainage valve (A) and can be changed over under tension in each case for opening and closing the drainage valve (A). By virtue of the changeover device (26) being arranged on the housing (22) of the drainage valve (A), the actuating part which contains the pushbutton (7) can be designed in a more space-saving and compact manner.

8 Claims, 7 Drawing Sheets

DEVICE FOR ACTUATING THE DRAINAGE VALVE OF A SANITARY ARTICLE

The invention relates to a device for actuating the drainage valve of a sanitary article, having a housing which can be fastened on the sanitary article and on which is mounted a pushbutton for actuating the drainage valve, and having a changeover device and a pulling element, which connects the button to a closure body which is mounted in a vertically displaceable manner in a housing of the drainage valve.

Such actuating devices are generally known, in particular, on bathtubs and washbasins. Actuation allows the closure body of the drainage valve to be raised, in order thus to open the valve, and lowered again, for closing the valve. The actuating element may be a pushbutton, as is disclosed in AT 317097 or DE 44 45 649 A. The movement of the pushbutton is transmitted to a cable of a cable pull via a changeover device. Arranged at the bottom end of the cable pull is a lever by means of which the closure body of the drainage valve can be raised and closed. A further device of the type mentioned has been disclosed in EP 1 118 724 A. In this document, the changeover device is arranged in the closure body.

The object of the invention is to provide a further device of the type mentioned which allows space-saving pushbutton actuation and is nevertheless of a comparatively straightforward design and functionally reliable.

The object is achieved, in the case of a device of the generic type, in that the changeover device is mounted on the housing of the drainage valve. The device according to the invention has the advantage that the actuating part which contains the pushbutton can be designed in a more space-saving and compact manner since the changeover device is arranged on the housing of the drainage valve. The changeover device may be arranged, in particular, laterally on this housing. A comparatively large amount of space is available here. The pulling element, for example a cable pull, can be guided in a concealed manner to this changeover device. Disadvantageous guidance of the pulling element into the closure body can be avoided.

According to a development of the invention, it is provided that the changeover device can be changed over under tension in each case for opening and closing the drainage valve. Such changeover under tension is more functionally reliable than changeover under compression.

A particularly functionally reliable configuration of the changeover device is ensured when, according to a development of the invention, the changeover device has a changeover part and a rocker which interact for opening and closing the drainage valve. It is particularly advantageous here if the changeover part is mounted in the pivotable manner in a slide and interacts under tension with the rocker.

According to a development of the invention, the slide is mounted in a slide housing which is inserted into part of the valve housing.

According to a development of the invention, it is provided that the rocker is connected to a fixed valve-lifter spindle. The movement of the rocker here is transmitted directly to a valve-lifter spindle by means of which the closure body of the drainage valve is raised, for example via a lever. This allows very effective force transmission.

According to a development of the invention, means for adjusting the changeover part are arranged on the slide housing. These restoring means can be realized very straightforwardly, for example by a projecting wall of the slide housing.

According to a development of the invention, it is provided that the rocker is latched in when the drainage valve is open. This ensures a precise opening position of the valve.

The device is suitable, in particular, for a sanitary article which requires an overflow opening.

Further advantageous features can be gathered from the dependent patent claims, from the following description and from the drawings.

An exemplary embodiment of the invention is explained in more detail hereinbelow by way of the drawings, in which.

Figure 5:
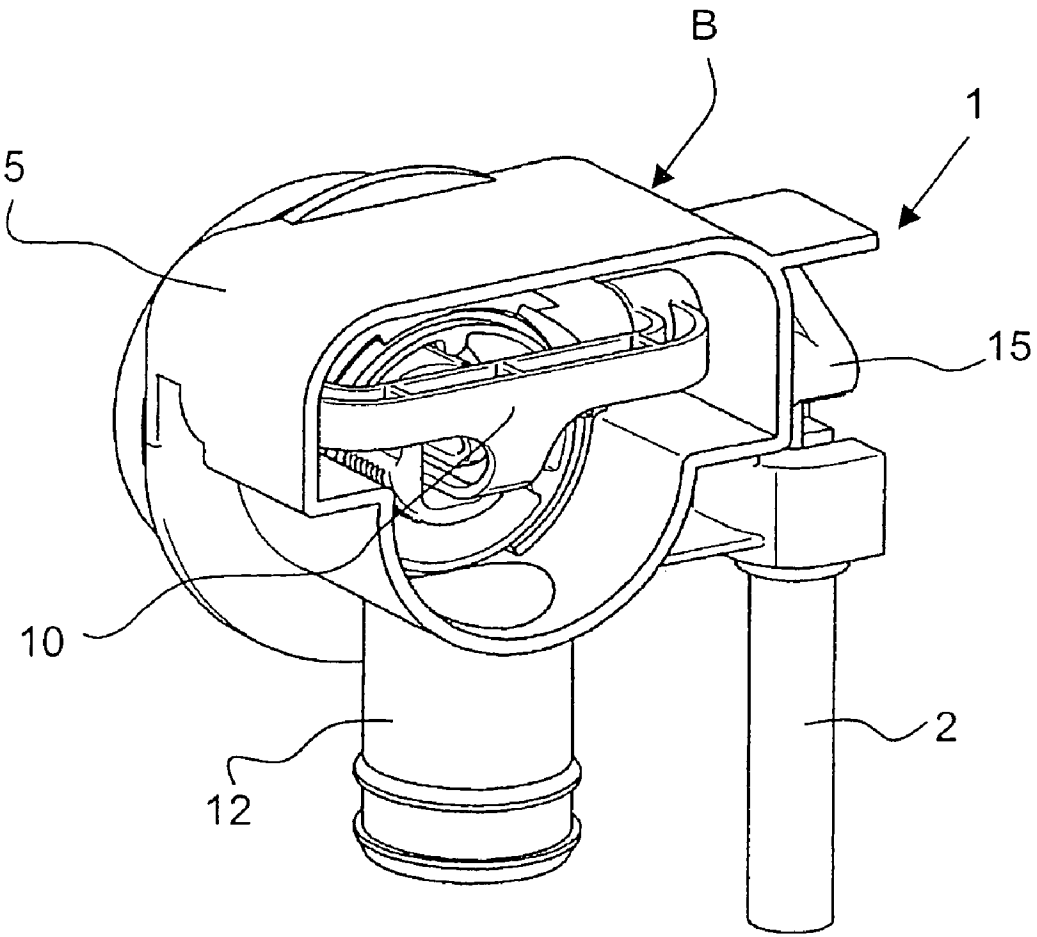
Figure 6C:
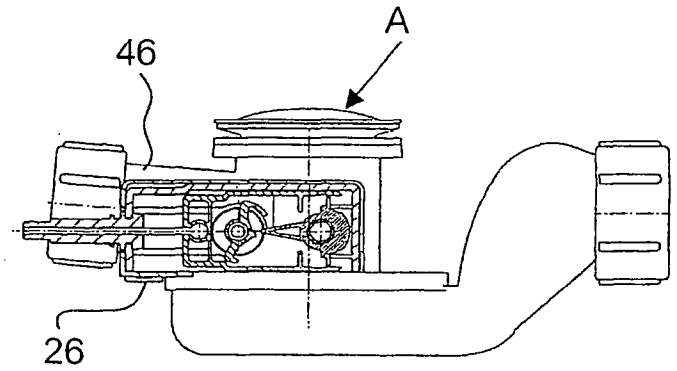
Figure 6D:
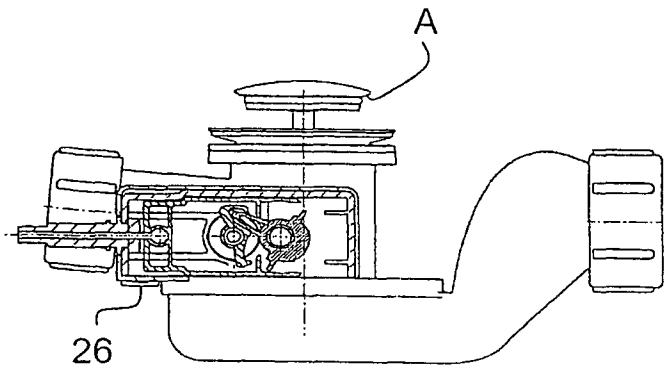
Figure 6A:
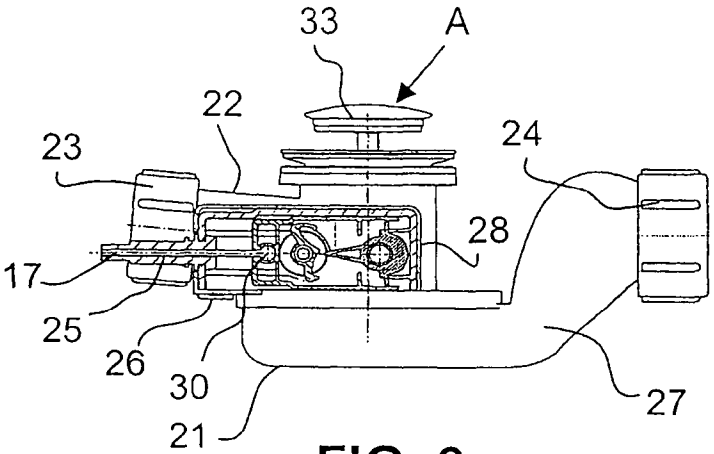
Figure 6B:
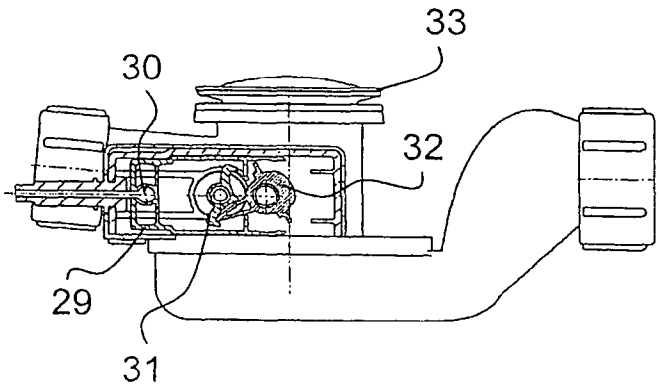

FIG. 5 shows a rear view of the overflow head, the cover having been removed for illustrative purposes, FIGS. 6*a* to 6*d* show a section through the drainage valve with different positions of the changeover device, FIGS. 7*a* to 7*d* show three-dimensional views, partly in section, of the drainage valve with different positions of the changeover device corresponding to FIGS. 6*a* to 6*d,* and FIGS. 8*a* to 8*d* show sections through the changeover devices in different positions in each case.

The device 1 comprises the drainage valve A, which is shown in FIGS. 6*a* to 6*d* and 7*a* to 7*d,* and the actuating head B, which is shown in FIGS. 1 to 5. The drainage valve A and the actuating head B are connected to one another by a cable pull 16. The actuating head B is fastened in an opening 3 of a sanitary article 2, for example a bathtub or washbasin. It has an overflow opening 9 through which overflowing water can pass into a connector 12 and, via an outflow pipe (not shown here), into a siphon 21 and, finally, into a further line (not shown here). The drainage valve A is fastened in a base of the sanitary article 2 (the base not being shown here). When the drainage valve A is open, water can likewise flow out of the sanitary article 2 into the siphon 21 and into the downstream line (not shown here).

Figure 2:
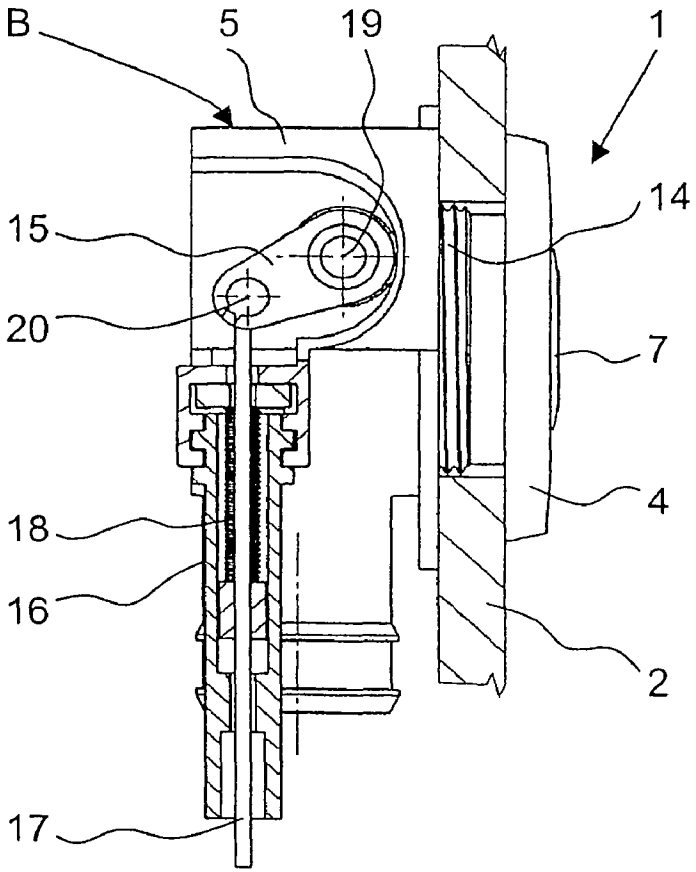
FIG. 2 shows a further section through the overflow head.
Figure 1:
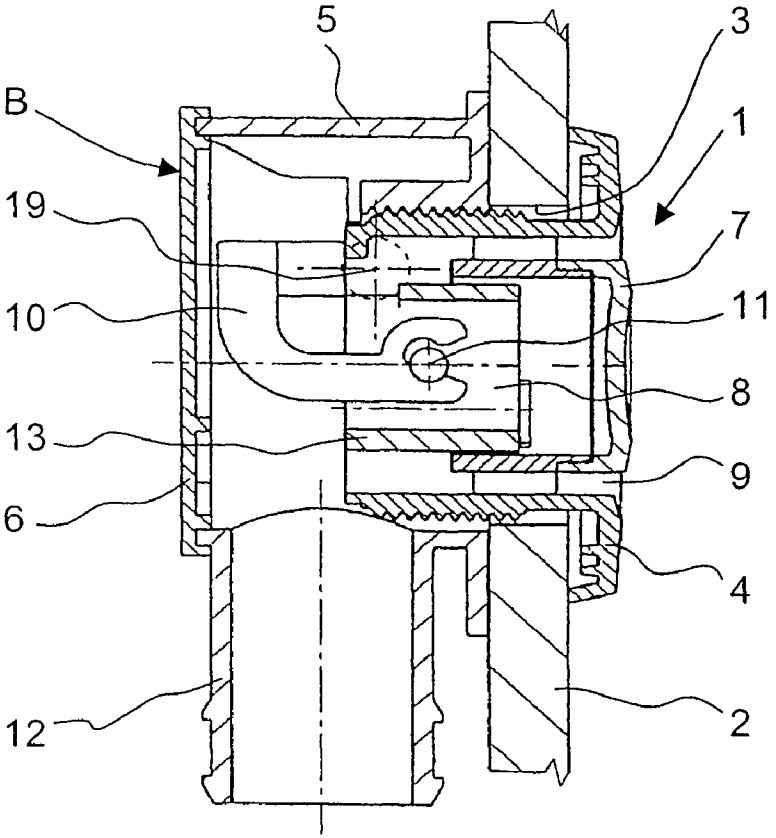
FIG. 1 shows a section through the overflow head.
Figure 4:
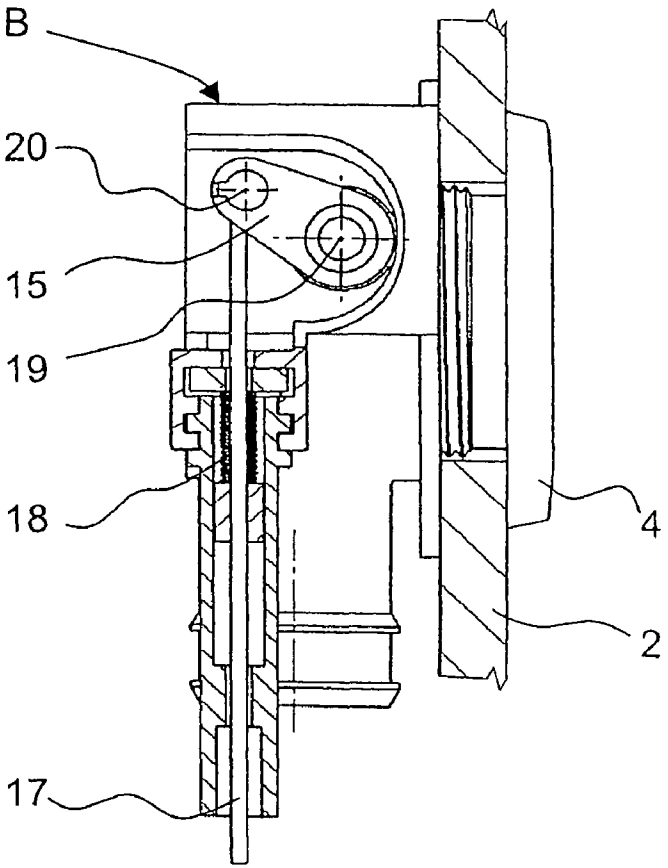
FIG. 4 shows a section according to FIG. 2, but following actuation.
Figure 3:
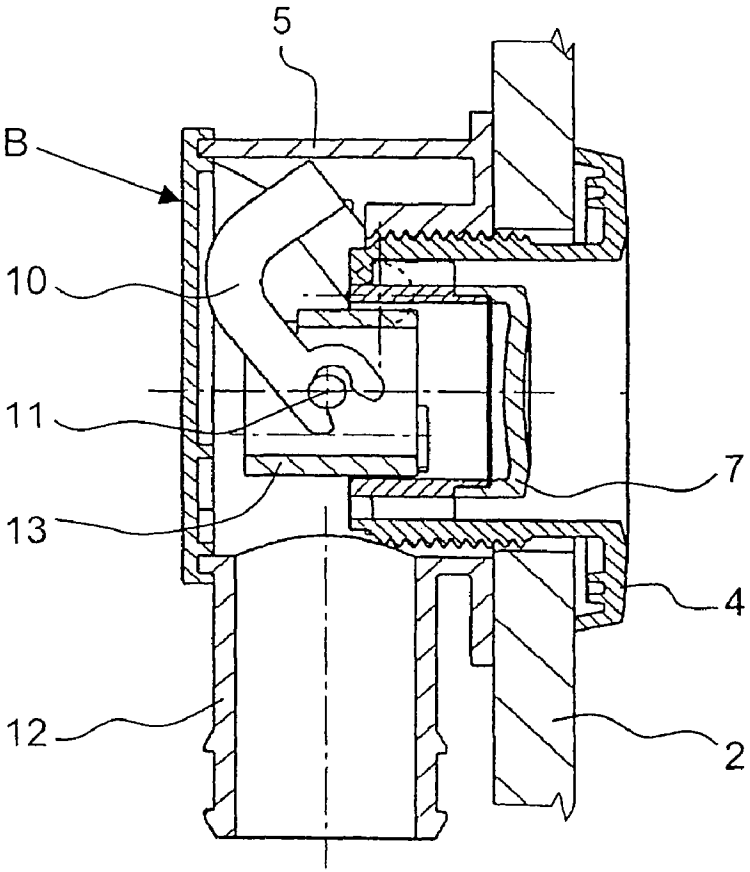
FIG. 3 shows a section according to FIG. 1, but following actuation.

The drainage valve A is actuated by virtue of a button 7, which according to FIG. 1 is mounted in the overflow opening 9, being pushed. Pushing displaces the button 7 from the position which is shown in FIG. 1 into the position which is shown in FIG. 3. In the non-actuated position according to FIG. 1, the button 7 has its front side essentially flush with a rosette 4. Following actuation, the button 7 moves back automatically again into the position which is shown in FIG. 1. The button 7 has been latched or screwed onto a guide sleeve 13 which is mounted in a displaceable manner in the rosette 4. Arranged in the guide sleeve 13 is a transversely running crosspiece 11 which acts on a lifter 10 which can be pivoted about a spindle 19, which is mounted in a housing 5 and is fixed to a lifter 15. If the button 7 is moved into the position which is shown in FIG. 3, then the lifter 10 pivots about the spindle 19 and thus pivots the lifter 15 from the position which is shown in FIG. 2 into the raised position, which is shown in FIG. 4. At a spacing apart from the spindle 19, the lifter 15 is connected to a top end 20 of a cable 17. The abovementioned pivoting movement subjects the cable 17 to predetermined lifting or pulling. At the same time, a spring element 18 is subjected to stressing.

Figure 8A:
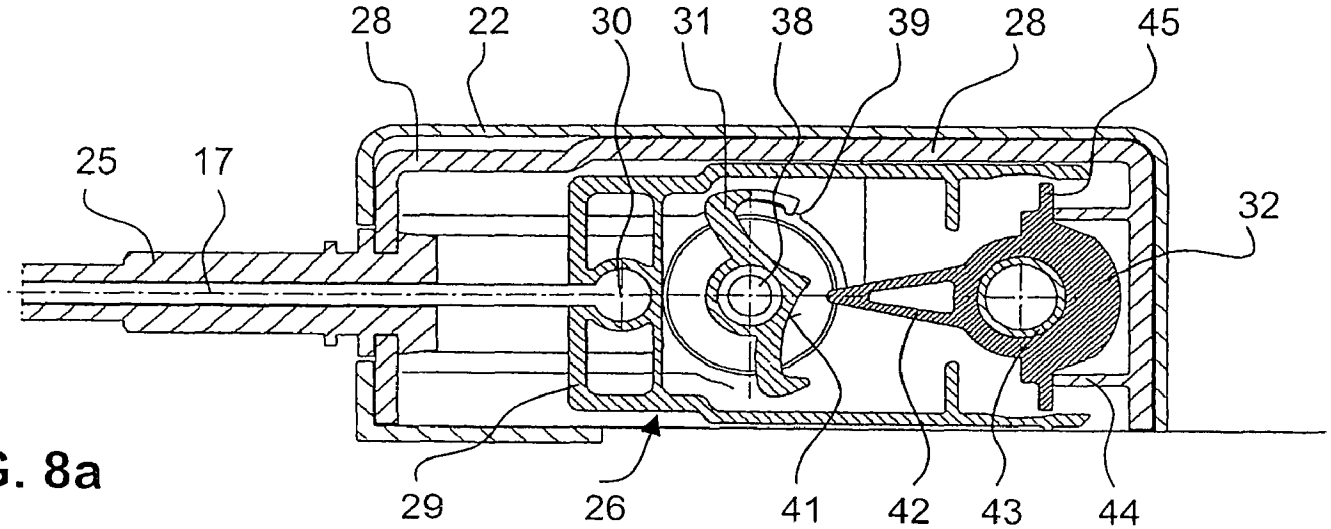
Figure 8B:
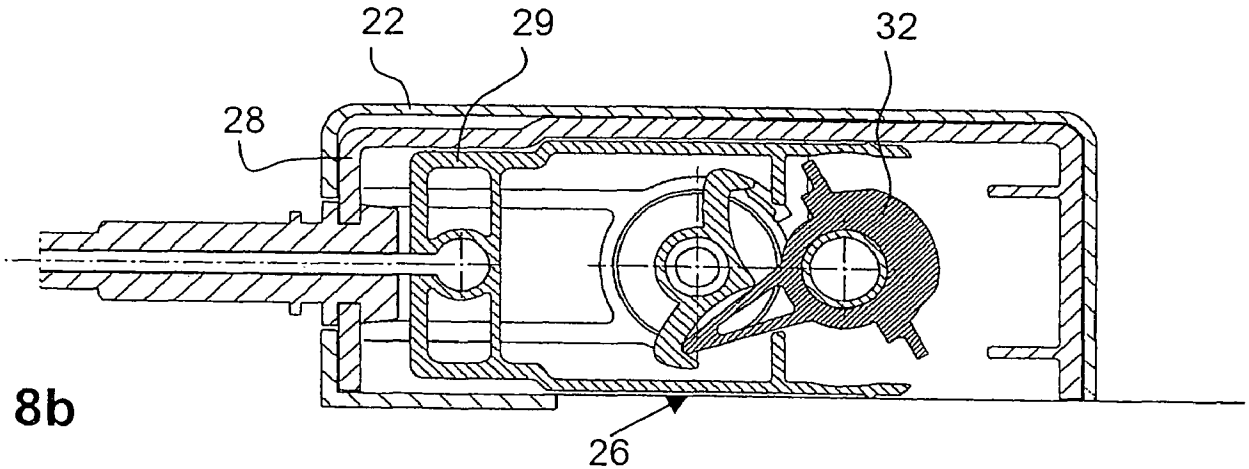
Figure 8C:
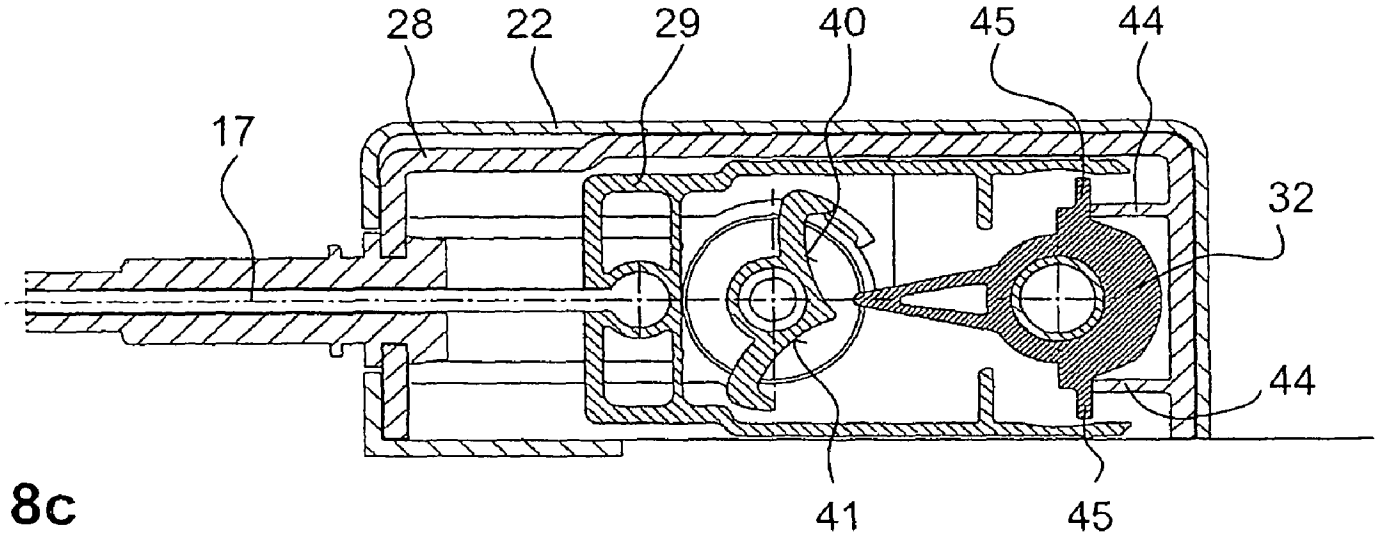

The cable 17 is connected, at a bottom end 30, to a slide 29 of a changeover device 26. The abovementioned pulling of the cable 17 causes displacement of the slide 29 from the position which is shown in FIG. 8*a* into the position which is shown in FIG. 8*b*. If the button 7 is released, then the spring element 18 is relieved of stressing and thus displaces the cable 17 once again into the position which is shown in FIG. 2. At the same time, the slide 29 is displaced into the position which is illustrated in FIG. 8. The abovementioned pulling of the cable 17 results in a raising action of a closure body 33 of the drainage valve A, which is thus opened. This is explained in more detail hereinbelow.

Figure 7C:
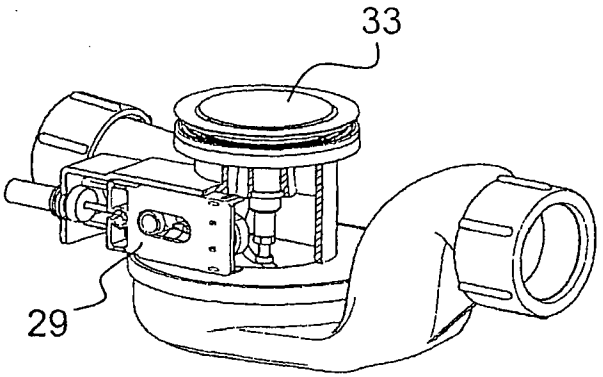
Figure 7D:
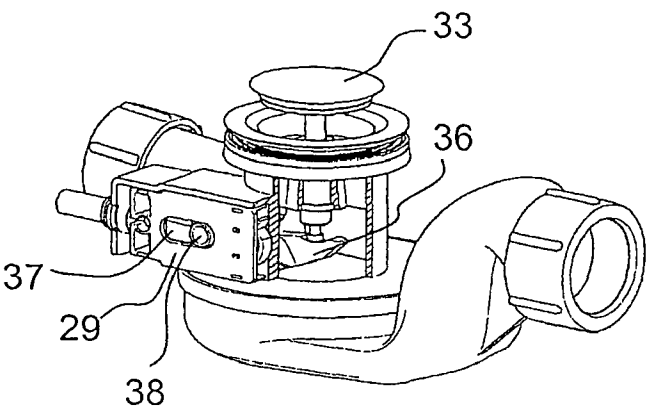
Figure 7A:
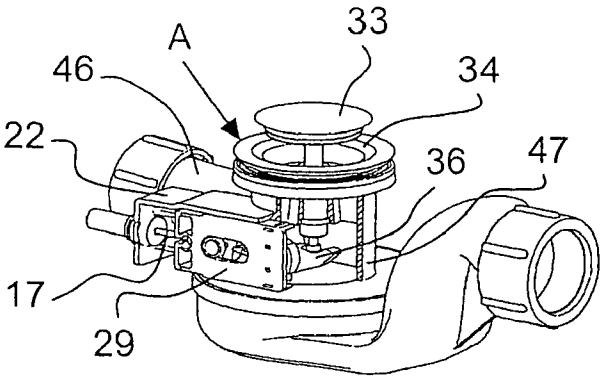

According to FIG. 8*a*, the slide 29 can be displaced linearly to a limited extent in a slide housing 28. A guide part 25 for the cable 17 is fastened on this slide housing 28. The slide housing 28 is inserted into the valve housing 22 of the drainage valve A. As FIG. 7*a* shows, the changeover device 26 is located laterally on the housing 22, to be precise alongside a connector 46, which is connected by means of a union nut 23 to the outflow pipe (not shown here). For illustrative reasons, the cover which closes the housing 22 has not been shown in FIG. 7*a*.

Arranged in the slide housing 28 is a rocker 31 which is fixed, via a spindle 38, to a valve lifter 36, which is shown in FIGS. 7*a* to 7*d*. This spindle 38 passes through a cylindrical, essentially vertically running wall 47 of the housing 22. The valve lifter 36 is located within this wall 47, and the rocker 31 is located outside this wall. According to FIGS. 7*a* to 7*d* the valve lifter 36 acts on a push rod 35, which is arranged on the underside of the closure body 33. The closure body 33 is mounted in a vertically displaceable manner within the wall 47 and, in the closed position, butts against a valve seat 34.

Figure 7B:
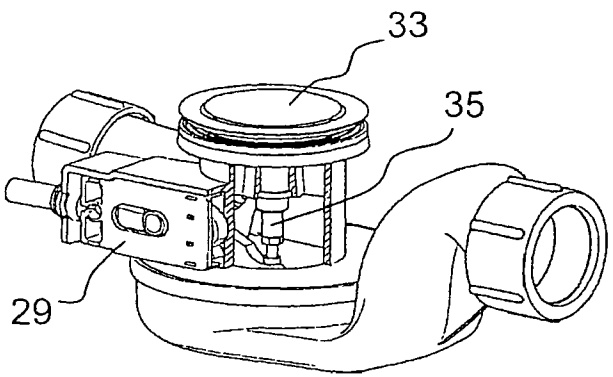

A changeover part 32 is mounted in a pivotable manner in the slide 21, on a spindle 43, and projects radially in relation to the rocker. The position which is shown in FIG. 8*a* is retained by two restoring parts 45, which each butt against a restoring means 44 of the slide housing 28. If the slide 29 is displaced from the high position, which is shown in FIG. 8*a*, into the position which is shown in FIG. 8*b*, then the snout 42 is pressed against a first curve 41 of the rocker 31. The rocker 31 is thus pivoted in the clockwise direction about the spindle 38 into the position which is shown in FIG. 8*b*. Since the spindle 38 is fixed to the valve lifter 36, the latter is pivoted downwards by this movement into the position which is shown in FIG. 7*b*. The valve body 33 thus moves downwards, on account of its own weight, and, finally, rests on the valve seat 34. If the button 7 is released, then the slide 29 is moved once again, on account of the pressure of the spring element 18, into the position which is shown in FIG. 8*a*. The weight of the closure body 33 means that the rocker 31 remains in the position which is shown in FIG. 3. The restoring parts 45 and the restoring means 44 result in the changeover part 32 moving back again into the aligned position according to FIG. 8*c*. The button 7 is likewise located, once again, in the position according to FIG. 1.

Figure 8D:
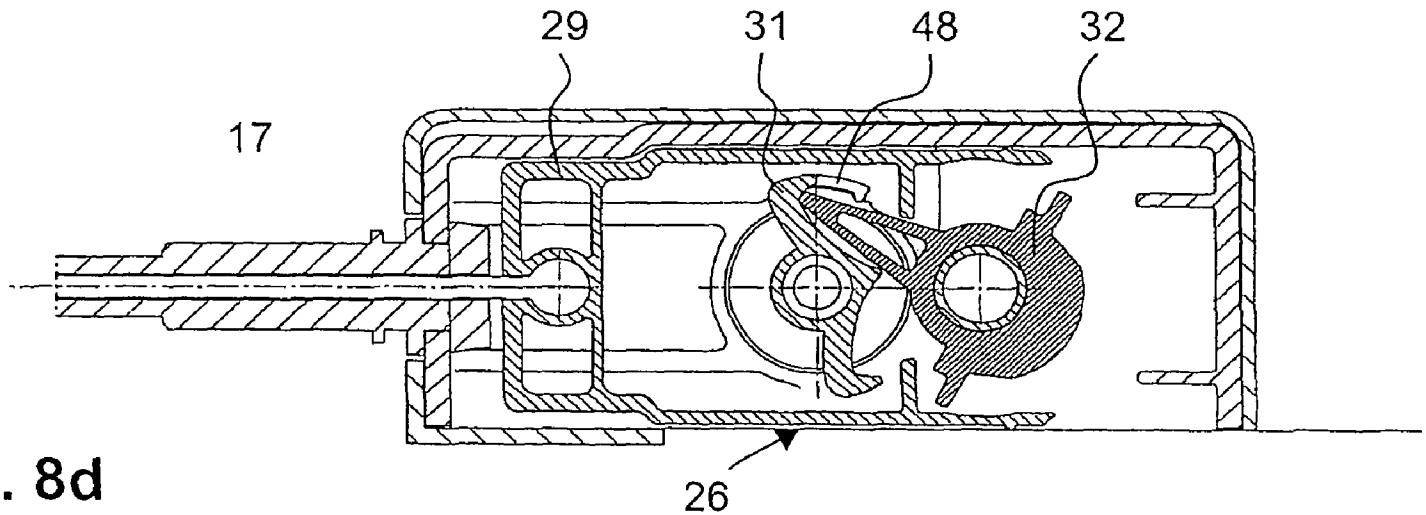

If the button 7, with the drainage valve A closed, is pushed, once again, into the position which is shown in FIG. 3, then the slide 29, in turn, is displaced to the left. The snout 42 then passes into engagement with a second curve 40 and thus pivots the rocker 31 into the position which is shown in FIG. 8*d*. Finally, a latching tongue 48 which is integrally formed on the rocker 31 is latched in an end position on a framework-mounted latching protuberance 39. By virtue of this movement of the rocker 31, the valve lifter 36 is raised into the position which is shown in FIG. 7*d* and, correspondingly, the closure body 33 is lifted off from the valve seat 34, the drainage valve A then being open. If the button 7 is released, then the slide 29 is displaced once again, on account of the pressure of the spring element 18, into the high position, which is shown in FIG. 8*a*. Since the rocker 31 has been latched as explained above, the closure body 33 remains in the raised position. The drainage valve A can then be closed again by virtue of the button 7 being pushed, as has been explained above. The essential factors are for the button 7 to be pushed inwards for each activation and for changeover to take place by way of the cable 17 being pulled. The cable 17 thus serves as a pulling element for changeover purposes. It can also be replaced, in principle, by any other suitable pulling element, for example by a linkage or the like.

LIST OF DESIGNATIONS

1. Device
2. Sanitary article
3. Opening
4. Rosette
5. Housing
6. Cover
7. Button
8. Guide sleeve
9. Overflow opening
10. Lever
11. Crosspiece
12. Connector
13. Guide sleeve
14. Thread
15. Lever
16. Cable pull
17. Cable
18. Spring element
19. Spindle
20. Top end of cable pull
21. Siphon
22. Valve housing
23. Union nut
24. Union nut
25. Guide part
26. Changeover device
27. Connector (siphon)
28. Slide housing
29. Slide
30. Bottom end of cable pull
31. Rocker
32. Changeover part
33. Closure body
34. Valve seat
35. Push rod
36. Valve lever
37. Slot
38. Spindle
39. Latching protuberance
40. Second curve
41. First curve
42. Snout
43. Spindle
44. Restoring means
45. Restoring part
46. Connector
47. Wall
48. Latching tongue
A Drainage valve
B Actuating head

The invention claimed is:

1. A device for actuating a drainage valve of a sanitary article, comprising:

a housing fastenable to the sanitary article and in which is mounted a pushbutton for actuating the drainage valve, said pushbutton being moveable from an actuation position by pushing inwards against the button to effect actuation of the drainage valve and being automatically moved back to the actuation position following actuation of the drainage valve, a changeover device, and a pulling element, which connects the pushbutton to a closure body which is mounted in a displaceable manner in a valve housing of the drainage valve, wherein said changeover device is mounted at the valve housing, wherein the changeover device has a changeover part and a rocker which interact for opening and closing the drainage valve, and wherein the changeover part is mounted in a pivotable manner in a slide and is changed over in each case for opening and closing the drainage valve.

2. The device according to claim 1, wherein the changeover device is changed over under tension in each case for opening and closing the drainage valve.

3. The device according to claim 1, wherein the slide is inserted laterally into part of the valve housing.

4. The device according to claim 1, wherein the rocker is connected to a fixed valve-lifter spindle.

5. The device according to claim 1, wherein means for restoring the changeover part are arranged at a slide housing.

6. The device according to claim 1, wherein the rocker is latched when the drainage valve is open.

7. The device according to claim 6, wherein the rocker is latched at the slide housing.

8. The device according to claim 1, further comprising an actuating head which has an overflow opening.

* * * * *